US006089408A

United States Patent [19]

Fox

[11] Patent Number: 6,089,408

[45] Date of Patent: Jul. 18, 2000

[54] REVOLVING HAIR COLORING CHEMICAL DISPENSER

[76] Inventor: Terry S. Fox, 2332 Paddstowe Main Way, Wake Forest, N.C. 27587

[21] Appl. No.: 09/049,223

[22] Filed: Mar. 27, 1998

[51] Int. Cl.[7] ..... B67D 5/60

[52] U.S. Cl. ..... 222/144; 222/181.2; 141/104

[58] Field of Search ..... 222/144, 162, 222/168, 181.2; 211/163, 77; 141/104, 100

[56] References Cited

U.S. PATENT DOCUMENTS

| | | | |
|---|---|---|---|
| 476,610 | 6/1892 | Crary | 222/144 |
| 888,464 | 5/1908 | Burri et al. | 141/104 |
| 3,718,234 | 2/1973 | Bagguley | 222/162 |
| 4,586,635 | 5/1986 | Collins, Jr. | 222/181.2 |

FOREIGN PATENT DOCUMENTS

| | | | |
|---|---|---|---|
| 867962 | 5/1961 | United Kingdom | 222/144 |

*Primary Examiner*—P. Derakshani

*Attorney, Agent, or Firm*—Coats & Bennett, P.L.L.C.

[57] ABSTRACT

A revolving hair coloring chemical dispensing carousel utilizes an identical pair of rounded, generally spaced apart support plates or racks which are rotatably mounted on a stationary base member. The support racks contain a series of passageways that are sized to accommodate either a large diameter container of developer solution or a smaller diameter container of colorizing pigment solution. More particularly, each cylindrical developer and pigment solution container is formed of a generally transparent material, such as clear plastic, and includes a plunger shaft which extends upwardly from the top portion of the container. The end of the plunger shaft positioned within the container housing includes a piston which facilitates the pushing or plunging of fluid confined within the fluid reservoir area of the container housing. The bottom end of the container housing includes a valve fixture, which is preferentially biased in the closed position by a helical biasing spring. When a force great enough to overcome the downward biasing force generated by the helical biasing spring is applied to the exposed tip of the valve fixture, fluid is allowed to flow from the fluid reservoir area of the container housing, through and out of the valve fixture.

29 Claims, 4 Drawing Sheets

REVOLVING HAIR COLORING CHEMICAL DISPENSER

FIELD OF THE INVENTION

The present invention relates to the dispensing of hair coloring chemicals and more particularly to a revolving carousel that houses a series of pigment and developer containers which allow these chemicals to be dispensed in precisely metered volumes.

BACKGROUND OF THE INVENTION

The cosmetic dying or coloring of hair requires the application of a colorizing solution which serves to permanently alter the color of the affected hair. In most instances, this colorizing solution is comprised of a number of individual color pigments which are mixed together to yield a particular color or color shade. Given the particular optical or color qualities of each individual color pigment, the mixing ratios required to derive any particular color or color shade are well known. Therefore, to produce a dye of a specific color simply requires the beautician to consult a document or table which lists the required pigments and the necessary mixing ratio for the desired dye color. As such, it will be appreciated that the reliable production of a particular dye color requires the relatively precise measurement and mixing of the individual pigment components that comprise the color. However, it is often the case that measurement of the exact quantities of each pigment required for the production of a particular color or color shade is a difficult task for the beautician. In general, the pigments are typically supplied to the user in individual bulk containers (typically squeeze type) from which they are eventually dispensed. Thus, the user is faced with the problem of dispensing the coloring pigments from the bulk containers in which they are stored in an accurate and reliable manner.

Not only is it difficult for beauticians to precisely dispense a certain amount from the respective tubes, but in typical beauty salons where many people have access to the color tubes, one often finds a great deal of disorganization. That is, the color dispensers are often found randomly mixed in one or more containers, some full and some only partially full. A great deal of time is lost by the beauticians in their effort to find and organize tubes of particular color. Needless to say, maintaining an appropriate level of inventory for all of the colors typically used is most difficult under the circumstances. Finally, the above approach does indeed lead to an undue amount of waste as partially filled tubes are often discarded.

Therefore, there is and continues to be a need for a dispensing device which allows beauticians to reliably dispense precisely metered volumes of hair coloring pigments and other chemicals (such as developer) associated with the dying or coloring of hair, such that the color or shade of the resulting pigmented hair coloring solution can be accurately controlled.

SUMMARY OF THE INVENTION

The present invention entails a carousel for holding and dispensing plunger type dispensers that are filled with hair coloring compositions. In particular, the hair coloring carousel includes a base and a carrier assembly rotatably mounted on the base. The carrier assembly includes a structure for receiving a plurality of dispensers. In a preferred embodiment of the present invention, the carrier assembly includes a pair of spaced apart racks with each rack including a series of openings formed therein and wherein the openings formed in an upper rack are aligned with the openings in the lower rack. A series of plunger type dispensers are secured within the aligned openings of the upper and lower racks. Each dispenser includes a transparent chamber having a plunger reciprocally mounted therein and a lower valve body. The transparent chambers are adapted to receive and hold either a hair coloring composition or a hair coloring developer composition. In a preferred embodiment, the various plunger type dispensers would include an array of different hair coloring compositions as well as a developer composition. By engaging the plunger of the respective dispensers, a beautician can selectively dispenser a predetermined quantity of material from a particular dispenser. By placing a mixing container below the level of the dispensers, the hair coloring compositions and the developer compositions can be dispensed within the mixing container. In fact, the mixing container can be maintained in a generally set or stationary position and the carousel or carrier assembly can be rotated to selectively align certain dispensers over the mixing container.

Consequently, the hair coloring carousel of the present invention maintains a full set of hair coloring dispensers in an organized state and enables a beautician to selectively dispense a certain quantity of a particular shade of hair coloring composition from a particular dispenser. Thereafter, the carousel can be rotated to where another dispenser is aligned with the mixing container in order that the selective formulation can be dispensed and mixed.

It is therefore an object of the present invention to provide a system for grouping and organizing an array of hair coloring dispensers together such that a wide range of different hair coloring compositions can be disposed at one location in easy reach of the beautician.

Another object of the present invention is to provide a hair coloring station that organizes and holds a series of hair coloring dispensers with certain dispensers holding different hair coloring compositions.

Still a further object of the present invention is to provide a hair coloring station in the form of a carousel that holds a series of hair coloring dispensers on a carousel such that the dispensers can be rotated about a generally vertical axis.

Still a further object of the present invention resides in the provision of a hair coloring carousel of the character referred to above which employs plunger type dispensers that permit a beautician to dispense a precise quantity of a selected hair coloring composition.

Other objects and advantages of the present invention will become apparent and obvious from a study of the following description and the accompanying drawings which are merely illustrative of such invention.

DETAILED DESCRIPTION OF THE INVENTION

Figure 1:
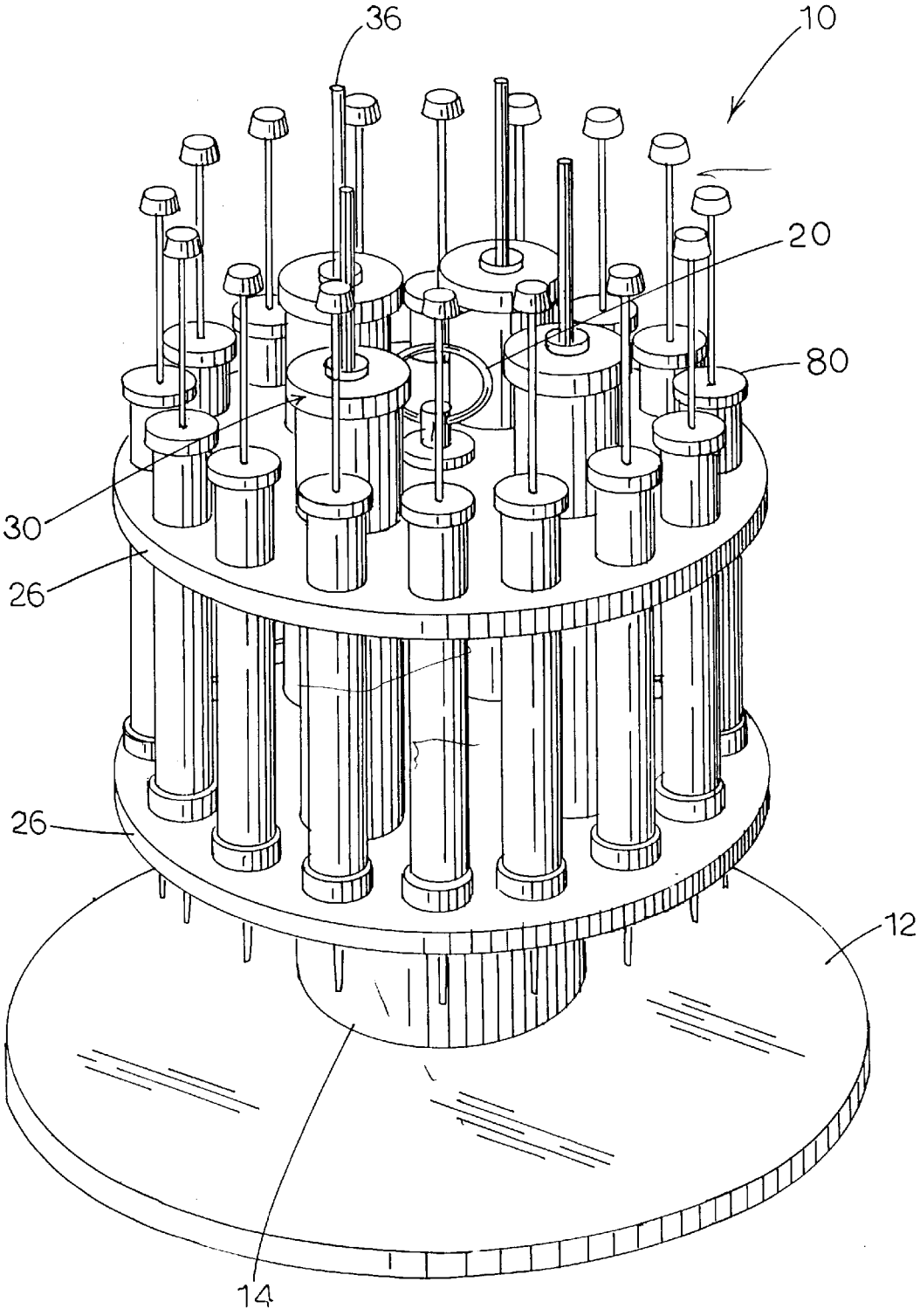
FIG. 1 is a perspective illustration of the dispensing carousel of the present invention.

Shown in FIG. 1 is a revolving hair coloring chemical dispenser of the present invention, generally indicated by the numeral 10. Dispenser 10 is comprised of a base plate 12, a first spacer 14, a rotary plate 16, a second spacer or sleeve 18, and an elongated tie rod or bolt 20 as further illustrated in FIG. 2. The elongated tie rod or bolt 20 includes a connector shaft. Also included in dispenser 10 are a pair of generally round, spaced apart supporting racks or plates 26, where each rack further includes a first series of small diameter openings 27 and a second series of four large diameter openings 28. In the embodiment disclosed herein, the supporting racks 26 are identical in size and shape, and furthermore, the positioning of the openings 27 and 28 is also identical in both racks.

Figure 2:
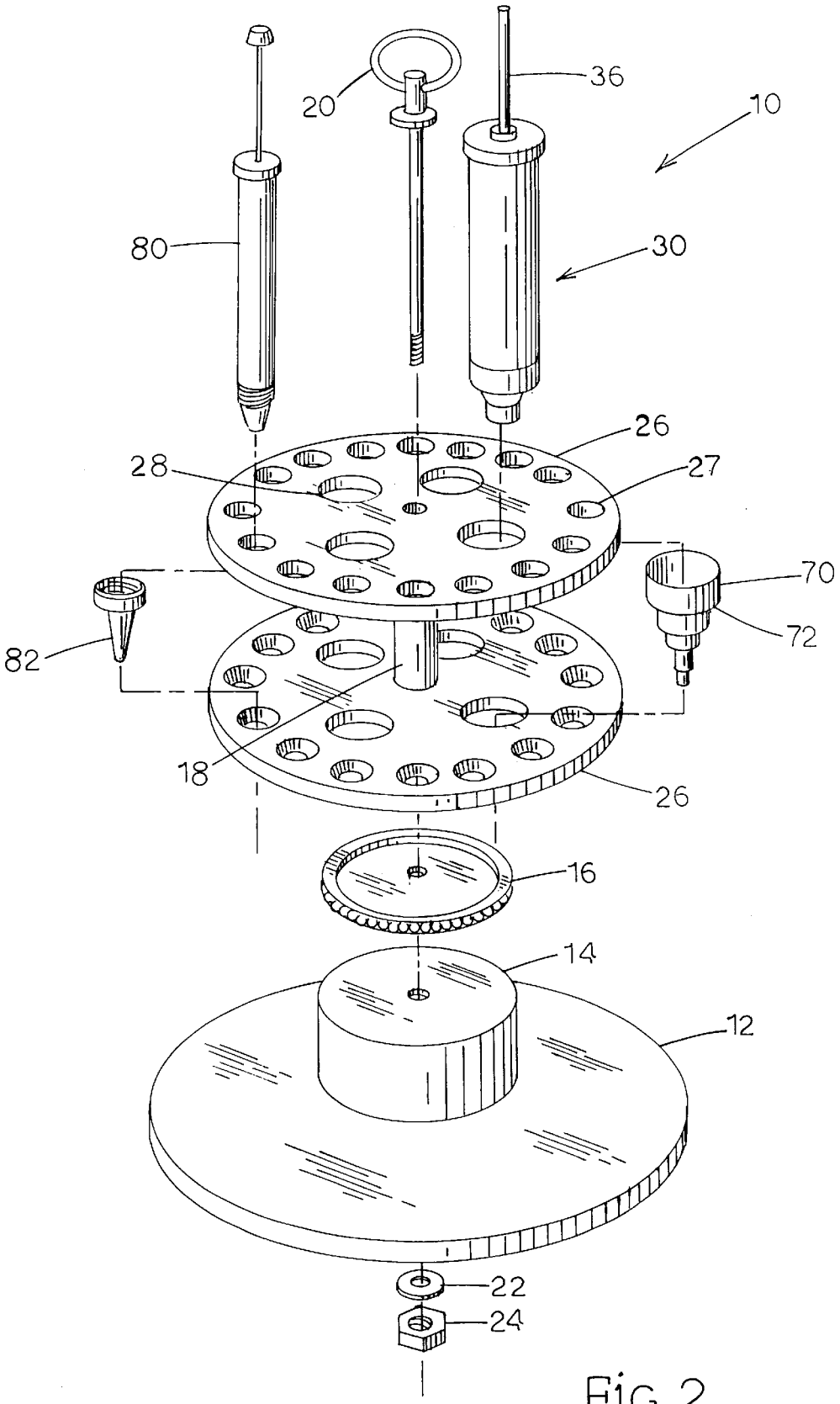
FIG. 2 is an exploded perspective illustration of the dispensing carousel of the present invention.

As shown in FIG. 2, the first cylindrical spacer 14 is seated directly above and on top of the base plate 12. Rotary plate 16, which can be of a lazy-susan type construction, is positioned above spacer 14, such that the lower face of the plate 16 is in contact with the spacer 14, while the upper face of the plate 16 is in contact with the lower support rack 26. The upper and lower racks 26 along with the spacer or sleeve 18 may be of a single unitary or integral construction. In the alternative, the upper and lower racks 26 along with the spacer sleeve 18 may comprise individual components that are essentially held together by the bolt 20 being appropriately secured within the spacer 14 that rests atop the base 12. The second spacer 18 is positioned above the lower support rack 26 so as to generally separate the lower rack 26 from the upper support rack 26. It will be appreciated from FIG. 2 that the individual components described above which comprise the revolving dispenser carousel 10 are connected and bound together via the elongated tie rod or shaft 20. As such, each of the components described above contains a central annulus or opening, along a common axis through which the tie rod 20 is inserted and generally secured by a washer 22 and threaded nut 24.

Being so configured, the resulting composite structure permits the general rotation of the supporting racks 26 about the tie rod or shaft 20. More specifically, during normal operation, the lower face of the rotary plate 16 remains stationary with respect to the adjacent base 12 and spacer 14, while the upper face of the rotary plate 16 is permitted to rotate or spin freely about the shaft 20. As the lower support rack 26 is in direct contact with the adjacent rotary plate 16, the lower support rack is also permitted to rotate or spin freely about the shaft 20. Thus, under normal operating conditions, the base 12 of dispenser 10 remains generally stationary, while the support racks 26 are free to rotate or spin about the shaft 20.

The particular construction of the hair coloring carousel 10 may vary from the design shown in the drawings and from the description set forth above. It is appreciated by those skilled in the art that the carrier assembly made up of the upper support racks 26 may be rotatively supported in various ways without departing from the present invention. In addition, the various components that make up the hair color carousel 10 can be constructed of various materials such as wood, plastic, metal, and the like.

Configured so as to pass through the openings 27 and 28, and effectively be seated within the spaced apart supporting racks 26 are a plurality of dispensing containers. In the embodiment described herein, the there are two types of generally cylindrical dispensing containers. There is a large developer container, generally indicated by the numeral 30, and a smaller pigment container 80, as shown in FIGS. 1 and 2. It should be appreciated that these dispensing containers operate in the same general manner, and with the exception of their size differential, they are functionally equivalent in all other respects. As such, only the larger developer container 30 will be described in detail herein. Furthermore, as such dispensing containers are known, the description that follows is intended primarily to provide a general description that illustrates the basic operating principles of the dispensers.

Figure 3:
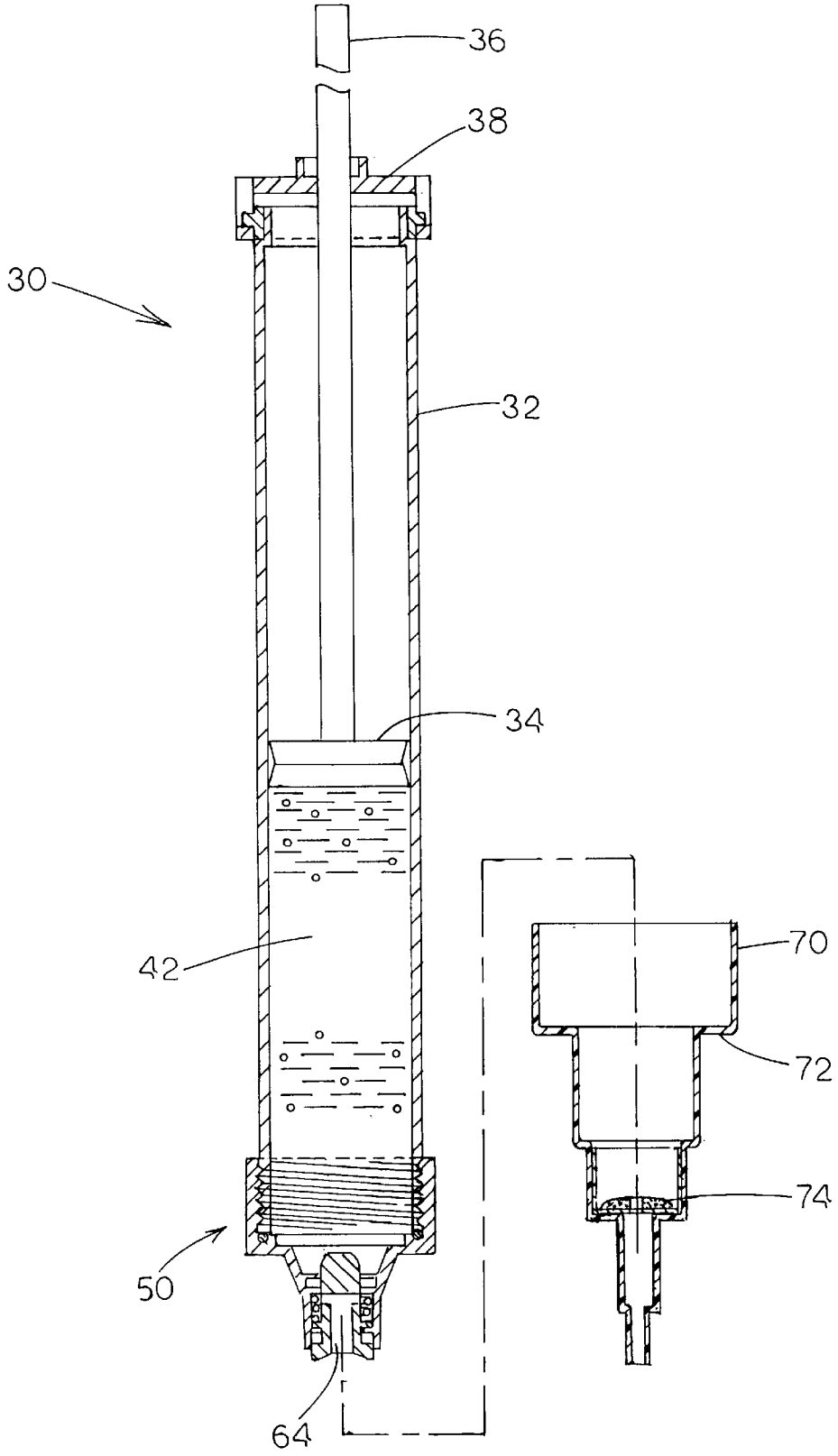
FIG. 3 is a side cross-sectional view of a dispensing tube and an associated nozzle.

Shown in FIG. 3 is a sectioned view of the developer dispensing container 30. Container 30 is comprised of a generally cylindrical housing 32 which is fabricated from a transparent material, such as a clear plastic polymer. The top end of the housing 32 is closed by a generally round, top cover 38. Top cover 38 contains a centrally located opening through which an elongated plunger shaft 36 is allowed to pass. As such, the upper portion of the plunger shaft 36 extends generally upwardly and away from the top cover 38, while the lower portion of the shaft resides within the housing 32. Disposed on the lower portion of the plunger shaft 36 is a piston 34, which is typically formed from a resilient material such as rubber, or the like. A sealed fluid reservoir 42 is consequently formed in the area between the plunger piston 34 and the bottom of the container housing 32, as shown in FIG. 3.

Figure 4B:
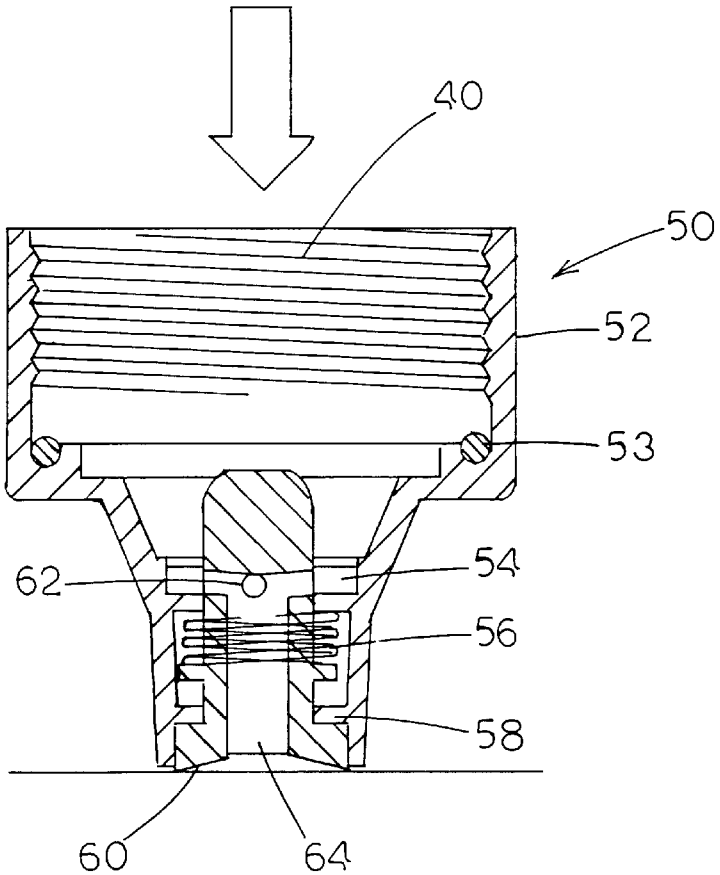
FIG. 4*b* is a partial side cross-sectional view of the dispensing tube tip illustrating the spring loaded check valve in an open configuration.
Figure 4A:
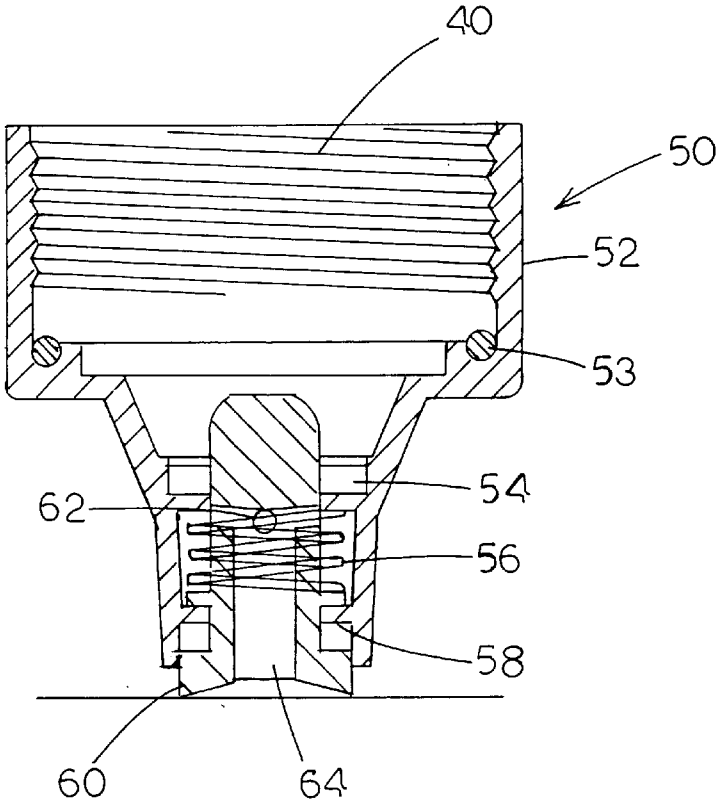
FIG. 4*a* is a partial side cross-sectional view of the dispensing tube tip illustrating the spring loaded check valve in a closed configuration.

The bottom end of the housing 32 contains a series of screw-type threads 40 which are machined into the housing surface, as shown in FIGS. 4*a* and 4*b*. A lower threaded tip of the housing 32 is adopted to be screwed into and be sealed within a valve fixture, generally indicated by the numeral 50. Valve fixture 50 includes a threaded housing 52 designed to be received and secured onto the container housing 32. Disposed at the base of the valve housing 52 is an O-ring type seal 53, typically formed of a resilient material such as rubber, or the like. When assembled, the O-ring 53 effectively forms a seal between the valve housing 52 and the container housing 32, thereby forcing all fluids contained within the housing 32 to flow through and not around the valve housing 52. Valve fixture 50 is further comprised of a fluid plenum area 54, a helical biasing spring 56, a valve stop flange 58, and valve body 60, a valve body inlet opening or port 62, and a valve body annulus 64, as illustrated in FIGS. 4*a* and 4*b*.

Valve body 60 is disposed within a passageway formed in the tip of the valve housing 52 and is prevented from sliding or falling out by the valve stop flange 58, as shown in FIG. 4*a*. Furthermore, the valve body 60 is preferentially forced or biased downward towards the tip of the valve housing 52 by the helical biasing spring 56 when not in use, once again as shown in FIG. 4*a*. This downward biasing actually results in the protrusion or extension of the valve body 60 from the lower tip of the valve housing 52. As such, the inlet port 62 which is communicatively coupled to the valve body annulus 64, is forced downward and out of the fluid plenum area 54. In such a closed configuration, fluid is not allowed to flow from the fluid plenum area 54, through the inlet port 62, and into the valve body annulus 64. Thus, when not in use, the valve body 60 is biased towards a closed configuration by the helical biasing spring 56, and consequently no fluid is permitted to flow from the fluid reservoir 42.

As shown in FIG. 4*b*, when a force great enough to overcome the downward biasing force generated by the helical biasing spring 56 is applied to the exposed tip of the valve body 60, the entire valve body 60 is forced upwardly and into the tip of the valve housing 52. As such, the inlet port 62 which is communicatively coupled to the valve body annulus 64, is forced upward and into the fluid plenum area 54. In such an open configuration, fluid is allowed to flow from the fluid plenum area 54, through the inlet port 62, and into and through the valve body annulus 64. Thus, when in use, the valve body 60 is moved upwardly towards an open configuration by a force that opposes the helical biasing spring 56, and consequently fluid is permitted to flow from the fluid reservoir 42.

Returning to FIG. 3, it will be appreciated that a generally hollow, actuating nozzle 70 is adopted to generally fit over and cover the tip of the valve fixture 50. As such, nozzle 70 is configured to receive and engage the tip of the valve housing 52 about a valve seat 74. More particularly, the valve seat 74 is designed so as to engage the protruding or extended tip of the valve body 60. Consequently, any net force applied to the nozzle 70 in a generally upward direction will be directly transferred to the exposed tip of the valve body 60, which will in turn tend to actuate the valve 50. Once actuated, the fluid passing through the valve body annulus 64 is directed generally through and out the tip of the nozzle 70.

It will also be appreciated from FIG. 3 that nozzle 70 also includes a stop flange 72 located on the outer or external surface. Returning now to FIGS. 1 and 2, it can be seen that the nozzles 70 are disposed to rest in the passageways 28 formed in the lower support rack 26 such that the stop flange 72 engages the upper surface of the lower support rack 26 immediately adjacent the passageway 28 and effectively prevents the nozzle 70 from passing completely through the passageway. As such, the wide end of the nozzle 70 that is intended to receive the container housing 32 is positioned generally above the top surface of the lower support rack 26, while the narrow or tip end of the nozzle 70 extends or projects through the passageway 28 and generally downwardly and away from the bottom surface of the lower support rack 26.

Loading of the developer dispensing containers 30 within the carousel 10 proceeds as follows. With the nozzle 70 placed within the lower rack 26, the developer container 30 is simply inserted or passed through the openings 28 in the upper rack 26 and moved downwardly through the upper rack until the tip of the valve fixture 50 engages the awaiting nozzle 70, which is aligned below.

As mentioned previously, the embodiment described herein includes two distinct container types, a developer container 30 and a color pigment container 80. While these two container types differ in size and shape, they are functionally identical. Therefor, it will be appreciated that the description of container 30, provided above, can be applied directly to the container 80. Besides the overall size of the container 80, the most noticeable difference involves the shape of the associated nozzle 82. Once again, the nozzle 82 is intended to provide the same function and perform identically to the nozzle 70 which is described above. Thus, the pigment container 80 is loaded into the carousel 10 in exactly the same manner as described above for the larger, developer container 30.

Actuation of the developer and pigment containers 30 and 80, respectively, is accomplished in exactly the same manner. Once again, for the purposes of illustration, actuation of the developer container 30 will be described below, with the understanding that the same description applies to actuation of the pigment container 80.

With the container 30 properly loaded in the carousel 10, as shown in FIG. 1, dispensing of the developer solution is accomplished through actuation of the valve fixture 50 disposed generally about the bottom end of the container housing 32. The valve fixture 50 is actuated when the plunger shaft 36, which extends generally upward from the top of the container housing 32, is manually forced downward. Because the fluid reservoir 42 is effectively sealed at both ends, the force applied to the shaft 36 results in the general downward movement of the entire container 30 relative to both the upper and lower supporting racks 26. As such, the valve fixture 50 which is attached to the lower end of the container housing 32 is effectively forced downward against the valve seat 74 formed in the inner surface of the stationary nozzle 70. More particularly, valve seat 74 engages the protruding tip of the valve body 60 and forces the valve body generally upward and into the valve housing 52, compressing the helical biasing spring 56, and driving the inlet port 62 into alignment with the fluid plenum area 54. As described above, such manipulation of the valve body 60 effectively actuates the valve and permits fluid from the reservoir 42 to flow through the fluid plenum area 54, into and through the valve body inlet port 62, into and through the valve body annulus 64, and ultimately into and through the hollow nozzle 70 where it is collected by the user.

It will be appreciated that an amount of force sufficient to overcome the closure biasing force provided by the helical biasing spring 56 must be manually applied to the plunger shaft in order to actuate the valve 50 and initiate fluid flow. Once the valve 50 is actuated and fluid flow has commenced, the user may monitor the amount of product dispensed by observing the change in fluid level within the transparent fluid reservoir area 42 of the container housing 32.

In a preferred embodiment, the transparent fluid reservoirs of both the pigment dispensers 80 and the developer dispensers 30 would include graduations inscribed on the surface of the fluid reservoirs so that the beautician dispensing materials from the dispensers can accurately judge the quantity or volume of material dispensed.

Once again, it should be appreciated that the dispensing of fluids from the pigment containers 80 is accomplished in the same manner as that described above for the developer containers 30.

In using the hair coloring carousel 10 of the present invention, the beautician or user places a mixing bowl on base 12 generally underneath the lower rack 26. Thereafter the racks 26 can be rotated to appropriately align either the coloring dispensers 80 or the developer dispensers 30 with the underlying mixing bowl. Thus, the beautician can select one or more pigment colors to dispense into the underlying bowl and can thereafter dispense the developer into the mixing bowl. In conventional fashion, once the coloring pigment and the developer has been dispensed into the mixing bowl, the entire formulation is mixed.

It is appreciated that the beautician or user of the carousel of the present invention, can precisely dispense a selected volume of any coloring pigment or developer. Consequently, the final formulation is more precise and consequently, the resulting color achieved in the dying process more closely approximates the color intended to be achieved from the various types of color pigments introduced into the formulation.

On a daily or routine basis, the individual dispensers, whether they be color dispensers or developer dispensers, can be refilled by removing the tops from the dispenser and directing coloring fluid or developer fluid downwardly through the open top of the respective dispensers.

Therefore, the hair coloring carousel 10 of the present invention has many advantages including a structure that maintains a plurality of coloring dispensers and a series of developer dispensers in an organized configuration about a rack. This enables the beautician or the user to gain easy and convenient access to the various dispensers and enables the beautician or the user to quickly and easily locate particular colors within the array of dispensers. In addition, the use of the dispensers disclosed herein eliminate waste that typically occurs with the use of conventional squeeze type tube dispensers. Finally, the dispensers that form a part of the hair coloring carousel 10 of the present invention enable a beautician or user to precisely dispense a certain amount of color pigment for the developer and therefore permits a more precise formulation to be achieved in the end.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

It is claimed:

1. A hair coloring carousel that enables a series of different hair coloring materials to be dispensed therefrom comprising: a base; a rotating carousel mounted on the base and rotatable thereon and including an upper rack and a lower rack with the respective racks being spaced apart; a series of openings formed in the upper and lower racks and wherein the openings in the upper rack are vertically aligned with the openings in the lower rack; and a series of hair coloring dispensers disposed in the openings formed in the carousel for holding a series of different hair colorings and for dispensing the same.

2. The hair coloring carousel of claim 1 wherein the openings formed in the carousel include a set of hair coloring dispenser openings and at least one developer opening.

3. The hair coloring carousel of claim 1 wherein the set of hair coloring dispenser openings are formed circumferentially around the carousel.

4. The hair coloring carousel of claim 1 wherein the carousel includes a sleeve extending between the upper and lower racks and an axis of rotation that extends through the sleeve.

5. The hair coloring carousel of claim 1 including a spacer interposed between the base and the carousel so as to define an area between the base and the carousel for receiving a mixing container.

6. The hair coloring carousel of claim 5 wherein the carousel extends outwardly from the spacer such that there is an open space is defined between the carousel and the base.

7. The hair coloring carousel of claim 1 including a connector shaft extending downwardly through an axial opening formed in the carousel and wherein the shaft connects to the base so as to support the carousel above the base.

8. A method of organizing hair coloring dispensers and dispensing a hair coloring composition from the dispensers comprising:

a. filling a series of plunger dispensers with different hair coloring compositions;

b. placing the hair coloring plunger dispensers on a rotating carousel;

c. supporting a mixing container under the rotating carousel;

d. rotating the carousel until a selected hair coloring plunger dispenser aligns with a mixing container supported underneath the carousel; and e. dispensing a selected volume of hair coloring composition from a selected plunger dispenser into the underlying mixing container by pressing a plunger associated with the plunger dispenser and pushing the plunger downwardly causing a selected volume of hair coloring composition to be dispensed into the underlying mixing container.

9. The method of claim 8 including filling at least one plunger dispenser with a developer composition and placing the developer plunger dispenser on the rotating carousel and selectively dispensing developer composition from the developer plunger dispenser into the underlying mixing container.

10. The method of claim 9 wherein the hair coloring plunger dispensers are disposed about a circumferential arc on the carousel and wherein the developer plunger dispenser is disposed inwardly of the series of hair coloring plunger dispensers.

11. The method of claim 8 wherein each hair coloring plunger dispenser includes a valve formed on a lower portion of the dispenser and wherein the valve is movable between open and closed positions.

12. The method of claim 11 wherein the valve is spring-biased towards a closed position.

13. The method of claim 12 wherein the carousel includes an upper rack and a lower rack and a connecting sleeve extending therebetween, and wherein there is further provided a base for supporting the carousel and wherein a connecting bolt extends downwardly through the carousel and connects the carousel to the base.

14. The method of claim 13 wherein the upper and lower racks includes openings formed therein and wherein certain openings of the upper racks align with certain openings of the lower rack such that respective hair coloring plunger dispensers can be inserted into aligned openings of the upper and lower racks.

15. The method of claim 14 wherein the hair coloring plunger dispensers each include a transparent outer housing and a plunger reciprocally mounted within the housing.

16. The method of claim 15 wherein each hair coloring plunger dispenser includes a detachable nozzle that is adapted to be disposed about the lower terminal end of the hair coloring plunger dispenser.

17. A hair coloring dispenser apparatus for organizing hair coloring dispensers and dispensing hair coloring compositions from the dispensers comprising:

a. a series of hair coloring plunger dispensers with each dispenser being adapted to be filled with a different hair coloring composition;

b. rotating carousel means for receiving the hair coloring plunger dispensers;

c. support means for supporting a mixing container underneath the rotating carousel;

d. means for rotating the carousel until a selected plunger dispenser overlies the mixing container; and e. means for dispensing hair coloring compositions from selected plunger dispensers including a plunger mounted within respective dispensers that act to dispense hair coloring compositions from the dispensers in response to pressing the plunger of a dispenser downwardly and dispensing a selected volume of hair coloring composition from the dispenser into the underlying mixing container.

18. The hair coloring dispenser apparatus of claim 17 wherein the support means includes a base and a spacer with the spacer being disposed between the base and the rotating carousel means.

19. The hair coloring dispenser apparatus of claim 18 wherein the rotating carousel means includes a pair of supports disposed in spaced apart relationship and including a sleeve connected therebetween and wherein the rotating carousel is rotatable about an axis that extends generally through the sleeve.

20. The hair coloring dispenser apparatus of claim 17 wherein said means for dispensing hair coloring composition comprises a valve associated with the respected dispensers and wherein the valve is moveable between an open and closed position and moves from a closed position to the open position in response to pressure being applied to the dispenser having the valve associated therewith.

21. A hair coloring dispensing apparatus comprising:

a. a base;

b. a dispenser rack supported on the base;

c. a series of hair coloring dispensers supported on the rack with respective hair coloring dispensers adapted to hold a different hair coloring composition;

d. a valve associated with respective hair coloring dispensers for measuring the flow of hair coloring composition from the dispenser; and e. wherein the rack is movably mounted on the base such that the rack along with the hair coloring dispensers can be moved from one location to another location, and wherein each hair coloring dispenser is at least partially transparent and includes a plunger having a piston for effectively driving the hair coloring composition from the respective dispensers.

22. The hair coloring dispensing apparatus of claim 21 wherein the dispenser rack is a rotating carousel having a series of openings formed therein for receiving the series of hair coloring dispensers.

23. A method of organizing different hair coloring compositions and dispensing respective hair coloring compositions from a series of dispensers comprising:

a. filing a series of dispensers with different hair coloring compositions;

b. supporting the different hair coloring dispensers on a rack;

c. supporting a hair coloring mixing container below the level of the hair coloring dispensers;

d. aligning the hair coloring mixing container with a selected hair coloring dispenser; and e. dispensing a selected volume of hair coloring composition from a certain hair coloring dispenser into the underlying hair mixing container.

24. The method of claim 23 including filing at least one dispenser with a developer composition and selectively dispensing the developer composition from a dispenser into the underlying mixing container.

25. The method of claim 23 wherein the hair coloring dispensers include a plunger and wherein dispensing a selected volume of hair coloring composition into the underlying hair coloring mixing container is performed by pressing the plunger downwardly into the dispenser and causing a selected volume of hair coloring composition to be dispensed into the underlying mixing container.

26. The method of claim 23 wherein each hair coloring dispenser includes a valve formed on a lower portion of the dispenser and wherein the valve is movable between open and closed positions.

27. A hair coloring dispenser apparatus for organizing a series of hair coloring composition and dispensing respective hair coloring compositions from the dispensers comprising:

a. means for holding a series of different hair coloring compositions including a series of hair coloring dispensers with each hair coloring dispenser receiving and holding one particular hair coloring composition;

b. means for supporting and holding the series of hair coloring dispensers including a rack for receiving and holding each of the hair coloring dispensers;

c. a hair coloring mixer support disposed below the hair coloring dispensers for supporting a mixing container that receives hair coloring compositions from the respective hair coloring dispensers; and d. means for dispensing hair coloring compositions from the respective hair coloring dispensers into the mixing container including a plunger disposed in each hair coloring dispenser and movable therein for dispensing the hair coloring composition from the plunger.

28. The apparatus of claim 27 wherein each hair coloring dispenser includes a see through outer housing that enables the hair coloring composition contained therein to be visible.

29. The hair coloring dispenser apparatus of claim 27 wherein the means for dispensing the hair coloring composition further comprises a valve associated with the respective dispensers and wherein the valve is movable between an open and closed position and moves from a closed position to an open position in response to pressure being applied to the dispenser.

* * * * *